US005752618A

United States Patent [19]

Trebitz et al.

[11] Patent Number: 5,752,618

[45] Date of Patent: May 19, 1998

[54] CARAFE FOR CARRYING A BEVERAGE WITH HOLDING RING STRUCTURE

[75] Inventors: Bernd Trebitz; Christof Kleemann; Karl Link, all of Bad Homburg, Germany

[73] Assignee: Braun Aktiengesellschaft, Germany

[21] Appl. No.: 845,575

[22] Filed: Apr. 25, 1997

Related U.S. Application Data

[63] Continuation of Ser. No. 502,495, Jul. 14, 1995, abandoned.

[30] Foreign Application Priority Data

Jul. 23, 1994 [DE] Germany ..... 44 26 233.7

[51] Int. Cl.[6] ..... B65D 7/44

[52] U.S. Cl. ..... 220/642; 220/737; 220/756; 220/758; 220/759; 220/769

[58] Field of Search ..... 220/642, 643, 220/737, 750, 758, 759, 769

[56] References Cited

U.S. PATENT DOCUMENTS

| | | | |
|---|---|---|---|
| 1,672,581 | 6/1928 | Sutcliffe et al. | 220/642 |
| 3,101,857 | 8/1963 | Freedman | 220/642 |
| 5,033,669 | 7/1991 | Federico | 220/642 |
| 5,190,209 | 3/1993 | Gordon et al. | 220/642 |

FOREIGN PATENT DOCUMENTS

| | | |
|---|---|---|
| 0 370 400 | 11/1988 | European Pat. Off. . |
| 0 413 196 | 2/1991 | European Pat. Off. . |
| 0 426 971 A1 | 5/1991 | European Pat. Off. . |
| U-78 29 785 | 2/1982 | Germany . |
| 85 33 996 U | 4/1987 | Germany . |
| 42 42 987 | 6/1994 | Germany . |

*Primary Examiner*—Joseph M. Moy
*Attorney, Agent, or Firm*—Fish & Richardson, P.C.

[57] ABSTRACT

The invention is directed to a carafe (10) for carrying a beverage, with a vessel (12) formed in particular from glass and having at its opening an upper rim (26) upon which a plastic ring structure (28) is seated. Because the thermal expansion of plastics is about 20 times greater than that of glass, the seat of the plastic ring (28) on the vessel (12) may work loose due to the effect of changing temperatures to which the carafe (10) is exposed as when hot or cold beverages are filled in. In order to ensure a consistently firm seat also at varying temperatures, it is proposed in the invention that the plastic ring structure (28) be provided with inner (30, 36) and outer (38) detent means rearwardly engaging inner (20) and outer (24) undercuts of the vessel (12).

15 Claims, 3 Drawing Sheets

CARAFE FOR CARRYING A BEVERAGE WITH HOLDING RING STRUCTURE

This is a continuation of application Ser. No. 08/502,495, filed Jul. 14, 1995, now abandoned.

This invention relates to a carafe for carrying a beverage, with a vessel formed in particular from glass and having a ring structure fitted thereon which includes, for example, a pouring spout or serves the function of attaching a handle to the carafe.

U. S. Pat. No. 5,379,925 describes such a carafe, including a glass vessel onto the upper opening rim of which a plastic ring of U-shaped cross-section is seated with its open profile facing down. A circumferential inner wall forming a leg of the U-shaped profile extends into the opening of the carafe, rearwardly engaging an undercut on the inner side of the vessel beneath its upper rim. The reason why the plastic ring rearwardly engages the vessel in its interior is that the thermal expansion of the plastics material employed is about 20 times greater than that of glass. When the carafe with its plastic ring is heated as, for example, by filling it with a hot beverage or cleaning it in a dishwasher, a firmer seat of the plastic ring on the vessel is obtained by virtue of the greater expansion of the plastic ring acting on the vessel interior.

Based on this realization, it is an object of the present invention to improve in a carafe of the type initially referred to the connection of the ring to the vessel and to ensure a uniformly firm seat of the ring at varying temperatures in order to obtain a good and lasting seat.

In the carafe of the present invention, the ring structure is pushed down over the upper rim of the vessel opening until locking engagement of the inner and the outer detent means occurs at the appropriate locations on the inside and outside of the vessel. The stability of the connection between ring and vessel is enhanced by the added provision of one or several outer detent means.

It is an added advantage in the carafe of the present invention that on temperature variations the inner and the outer detent means have a compensating effect in respect of their contribution to the stability of the connection of the ring to the vessel: For example, when the ring expands by a greater amount than the vessel on an increase in temperature resulting from filling a hot beverage into the carafe or from cleaning the carafe in a dishwasher, the inner detent means are urged against the vessel from the inside with a greater force, thus increasing the stability of the connection between the ring and the vessel. Any reduced holding force of the outer detent means is thereby compensated for. When the temperature is lowered as, for example, by filling an ice-cold drink into the vessel, the relationships are reversed. A consistently stable connection between the ring and the vessel at varying temperatures results, ensuring a lasting good seat of the ring on the vessel.

In cases where the ring and the handle are formed from a single plastic molding, it is in the first place the elastic outer detent means of the invention that make it possible that the weight when holding a full carafe is transmitted through the outer detent means to the ring and onwards to the glass body without detrimental effect, without requiring the handle and the ring to be connected with the glass carafe by additional joining methods such as adhesive bonding or bolting. The inner detent means formed by a closed ring serve a sealing function on the inner rim of the glass vessel, in addition to centrally locating the ring on the glass vessel and compensating for any clearance. Caused by the weight of the glass vessel and the liquid it carries, the force supporting function is predominantly performed by the outer detent means. By virtue of the arrangement of the present invention in combination with the features of claim 2, a ring structure fixedly retained to the glass vessel in a simple manner and provided with a handle is obtained, which is detachable from the glass vessel only by destruction.

Preferably, the outer detent means extend(s) away from the ring structure in an inwardly upwardly inclined direction, thereby bearing at approximately right angles against an upwardly widening section of the vessel, which section adjoins the upper rim of the vessel opening in downward direction and forms the outer undercut. As a result, the transmission of a force between the vessel and the ring structure occurs predominantly in the longitudinal direction of the outer detent means. A transverse force which would urge the outer detent means out of its or their engagement with the outer undercut does not take effect or is at most negligibly small. In addition, the inclined position of the outer detent means contributes to attaching the ring to the vessel: As the ring is pressed into engagement with the vessel, the outer detent means is or are urged outwardly by the vessel upper rim until it or they snap(s) into engagement with the outer undercut beneath the rim.

Where several outer detent means are employed, these are preferably separate elastic detent means circumferentially spaced on the ring. It is to be understood, however, that the elastic detent means may also be comprised of only one single, circumferentially arranged detent means or of one single, tongue-shaped detent section preferably formed beneath and in the proximity of the handle for enhanced stability. By contrast, the inner detent means preferably combine to form a hollow ring which forms part of the ring structure seated down onto the upper rim of the vessel and extends into the vessel interior and widens at its end reaching into the vessel interior such as to rearwardly engage the inner undercut of the vessel. The inner undercut is formed by an upwardly tapering section of the vessel adjoining the lower end of the upwardly widening vessel section forming the outer undercut. The widening and the tapering sections combine to form a neck of the vessel. The enlargement of the ring rearwardly engaging the inner undercut of the vessel rests sealingly against the vessel, thus preventing liquid from seeping between this enlargement of the ring and the vessel as when pouring liquid from the vessel.

Above or outside the outer detent means, the ring structure is provided with openings of the same size as, or greater than, the contour of the respective detent means, as seen looking through the particular opening. The openings serve to unmold the ring when it is manufactured as an injection molding: Where the openings are provided in the upper part of the ring, one part of an injection mold is provided with projections extending through the ring openings to be manufactured, the end surface of the projections providing a mold surface for shaping an upwardly inclined outer surface of the respective outer detent means. To open the mold following injection molding, this part of the mold is removed, causing the projections to be withdrawn from the openings. Where the openings are provided in the ring radially outside the outer detent means, parts are inserted into the mold from outside, their end surface providing a mold surface for shaping an outer surface of the respective detent means. Following injection molding, these parts can be withdrawn radially outwardly from the openings of the ring and removed from the injection mold, whereupon the mold is opened for removal of the finished ring.

In its area embracing the upper rim of the vessel, the ring structure includes on its underside spacing means abutting the rim of the vessel in the form of, for example, elastic rib members extending transversely to the rim and biased into engagement with the rim of the vessel with the detent means locked in place. This provides a clearance-free connection of the ring to the vessel.

The ring structure is preferably fabricated from plastics. It may include a pouring spout or a handle for the carafe, which are integrally formed with the ring particularly if the ring is made of plastics. Further, it is advantageous to provide the ring structure with a heat-insulating hand guard covering the vessel on the outside in the area of the handle, thus preventing that a hand holding the carafe by its handle contacts the possibly hot vessel. This hand guard, too, may be integrally formed with the ring.

In a preferred embodiment of the present invention, the ring structure is configured to receive a lid for the carafe. For releasable attachment of such a lid to the carafe, the ring may include receiving sockets known per se in the area of the handle for pivotally mounting the lid thereon. The ring may also be provided with an internal thread for threadably engaging the lid.

An embodiment of the present invention will be described in more detail in the following with reference to the accompanying drawings. In the drawings, FIG. 1 is a part sectional view of a carafe of the present invention;

Figure 1:
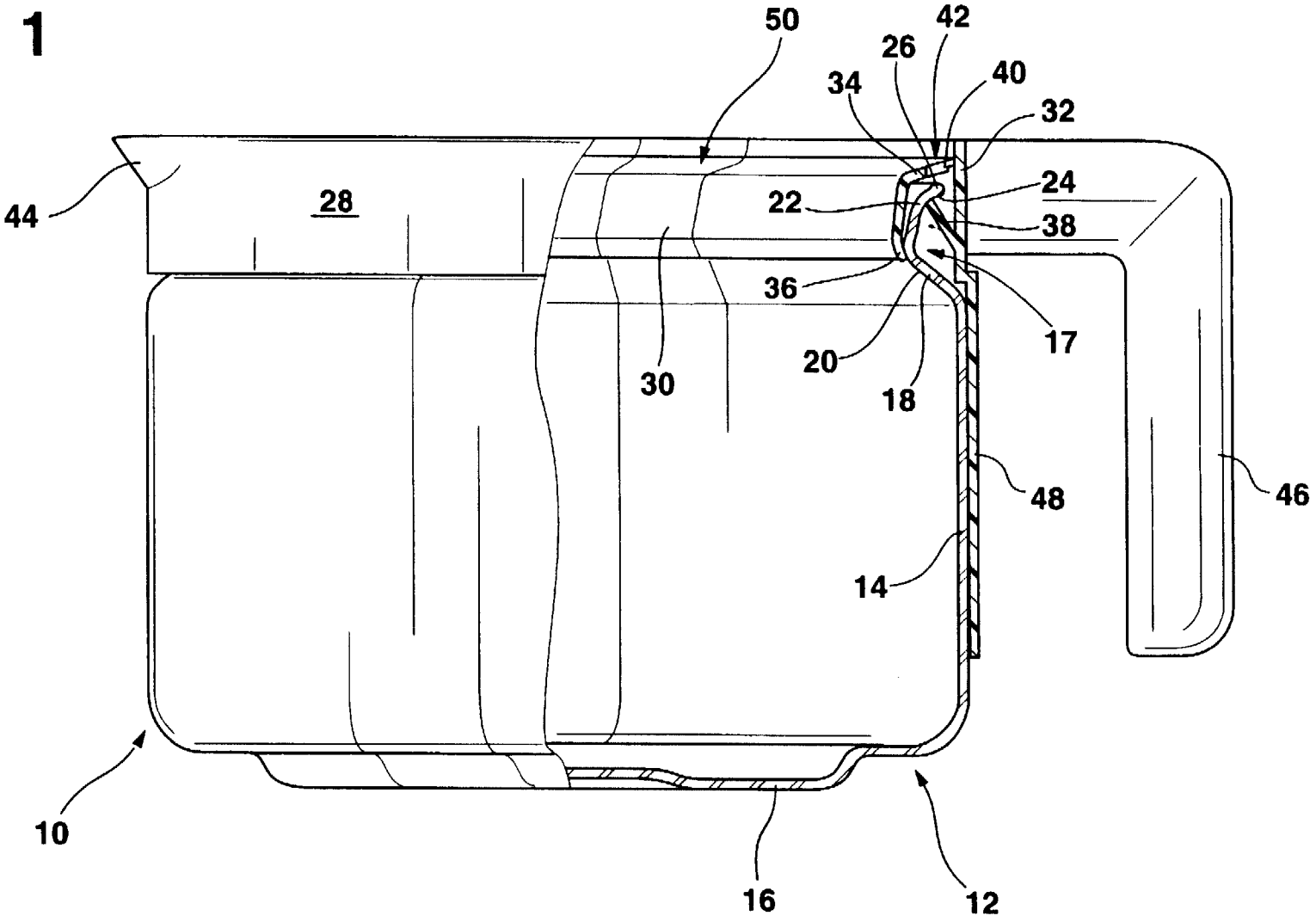
FIG. 1 shows as an embodiment of the present invention a carafe for carrying beverages generally designated by reference numeral 10, in which the right-hand half of the illustration is shown in a sectional view, while the left-hand half is shown in an elevational view.

The beverage carafe 10 comprises a vessel 12 formed from glass. The glass vessel 12 is of a bowl-shaped configuration, including a circumferential wall 14 terminating with a bottom 16 at its lower end. Beneath an upper rim 26, the vessel 12 includes a neck 17 comprised of a tapering section 18 and an outwardly curving section 22. An inner surface of the section 18 tapering in the manner of the frustum of a hollow cone provides an inner undercut 20 of the glass vessel 12. The circumferential wall 14 then continues upwardly into the section 22 curving radially outwardly in an arcuate configuration, the outer surface of this section forming an outer undercut 24 of the vessel 12. The vessel 12 terminates with an upper rim 26 formed by the free end of the outwardly curving section 22.

Seated down onto the upper rim 26 of the vessel 12 from above is a plastic ring structure 28. This plastic ring structure 28 is of U-shaped cross-section, the "U" having two leg walls 30, 32 extending along the outer and inner surface of the circumferential wall 14 of the vessel 12 down to the vessel section 18 shaped in the manner of the frustum of a hollow cone. A yoke wall 34 embraces the upper rim 26 of the vessel 12. The three walls 30, 32, 34 of the plastic ring structure 28 are integrally formed.

The inner leg wall 30 provides a circumferential inner detent means, its free underside being curved outwardly, thereby providing an enlargement 36 rearwardly engaging the inner undercut 20 of the vessel 12.

Extending away from the inside of the outer leg wall 32 in an inwardly upwardly inclined direction are outer detent means 38. These outer detent means 38 abut the outer undercut 24 of the vessel 12 at approximately right angles. The inner and the outer detent means 30, 36, 38 provide for connection of the plastic ring structure 28 to the vessel 12.

The yoke wall 34 has on its underside several rib members extending radially from the inner to the outer leg wall 30, 32 and serving as spacing means 40 circumferentially arranged on the plastic ring structure 28. The plastic ring structure 28 bears with its spacing means 40 against the upper rim 26 of the vessel 12. The spacing means 40 are somewhat deformed elastically, thus enabling the plastic ring structure 28 to be biased into clearance-free engagement with the upper rim 26 of the vessel 12.

Above the outer detent means 38, openings 42 are provided in the yoke wall 34 which correspond in form and size to the contour of the outer detent means 38, when viewing the detent means through the respective opening 42. These openings 42 serve to unmold the plastic ring 28 from an injection mold, as will be explained with reference to FIG. 3.

The plastic ring structure 28 includes a pouring spout 44 as well as a handle 46 arranged opposite the pouring spout 44 and integrally formed with the plastic ring structure 28. At the location where the handle 46 is situated, a tab integral with the plastic ring structure 28 extends downwardly along the vessel 12, the tab providing a hand guard 48 engaging the outside of the circumferential wall 14 of the vessel 12 in the area of the handle 46.

Figure 2:
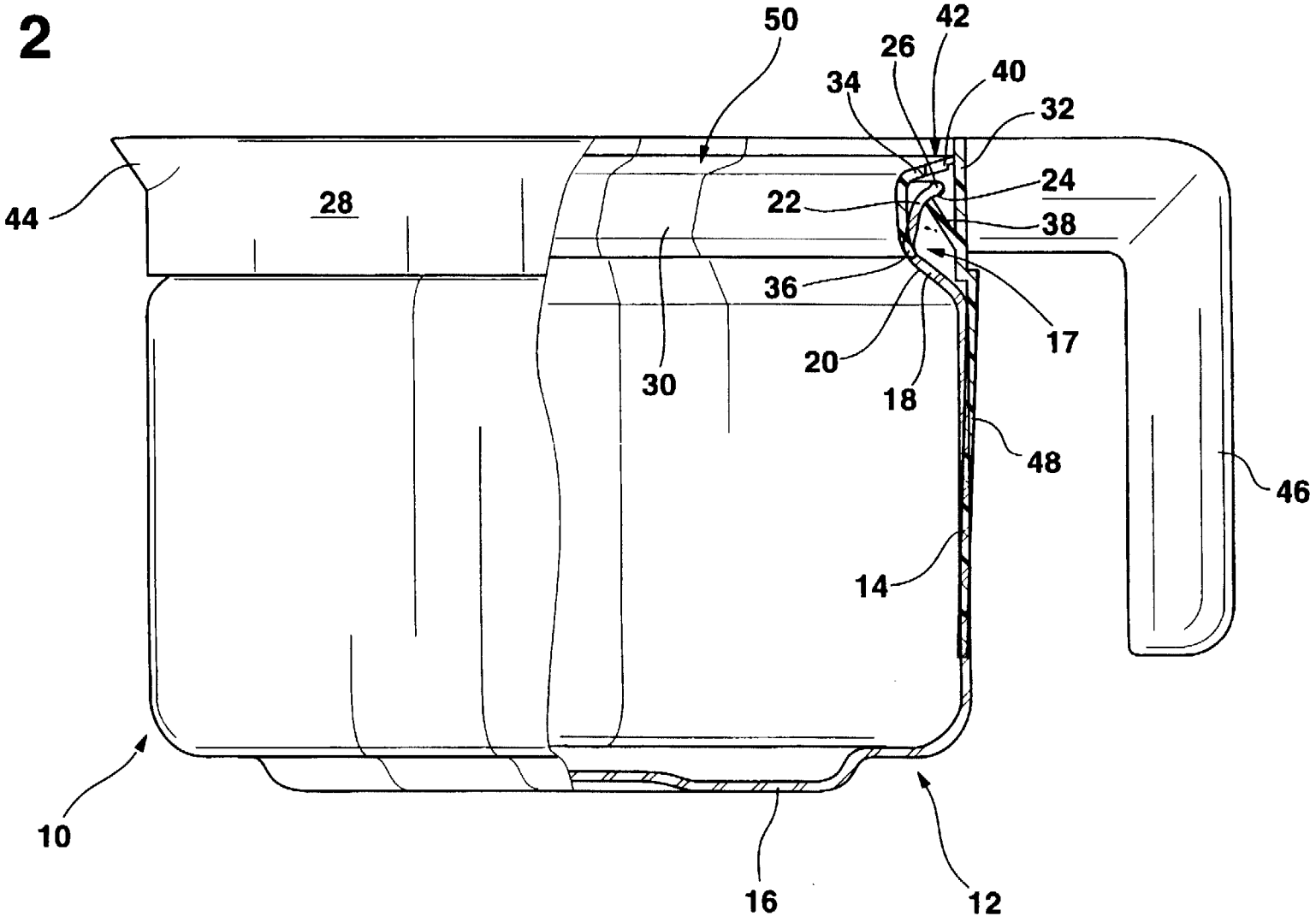
FIG. 2 is a view as in FIG. 1, but showing the ring structure as if it were not attached to the vessel.

In FIG. 2, the plastic ring structure 28 is drawn as if it were not attached to the vessel 12. It will be apparent that the outside diameter of the inner detent means 30, 36 is greater than the clear width of the opening 50 at the upper end of the vessel 12. As a result, the inner detent means 30, 36 is biased against the inside of the vessel 12, being urged into engagement with the inner undercut 20 of the vessel 12 which it engages rearwardly.

In unstressed condition, the hand guard 48 extends slightly inwardly in downward direction. With the plastic ring structure 28 fitted onto the vessel 12, the hand guard is thereby equally biased into engagement with the outside of the circumferential wall 14 of the vessel 12.

To mount the plastic ring 28 on the vessel 12, the plastic ring 28 is pushed down onto the upper rim 26 of the vessel 12 from above. As this occurs, the elastic outer detent means 38 are urged outwardly by the upper rim 26 of the vessel 12, and the circumferential inner detent means 30, 36 is elastically compressed on the inside of the vessel 12 until the detent means 30, 36, 38 lock into their appropriate locations provided on the vessel 12. The enlargement 36 of the plastic ring 28 rests against the inner undercut 20 of the vessel 12 in sealing engagement therewith, engaging it rearwardly.

Figure 3:
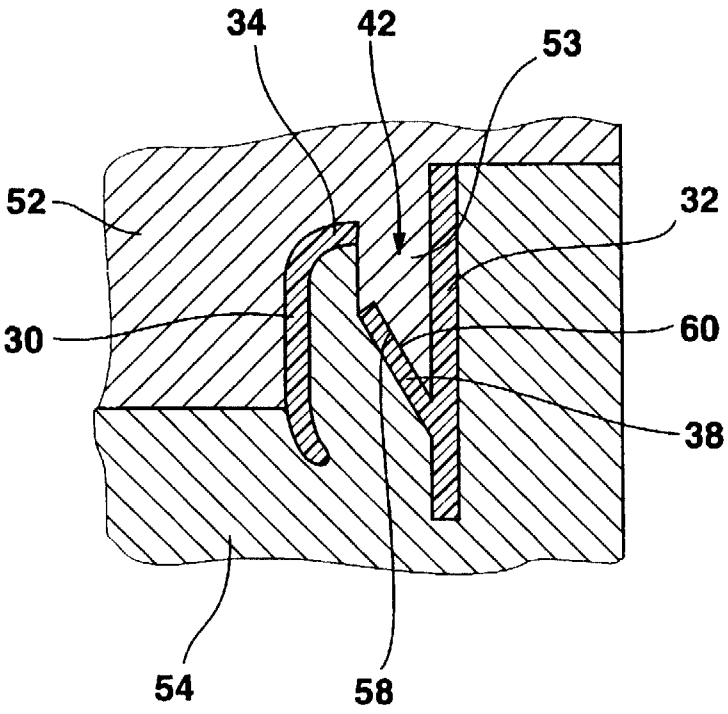
FIG. 3 is a schematic view of a portion of an injection mold.

FIG. 3 shows a section through an injection mold comprised of an upper mold part 52 and a lower mold part 54 for manufacturing the plastic ring structure 28. The FIGURE shows only that portion of the mold 52, 54 where one of the outer detent means 38 of the plastic ring 28 is provided. Elements of the plastic ring structure 28 visible in this FIGURE are, apart from the outer detent means 38, the inner and the outer leg wall 30, 32 as well as the yoke wall 34 which is interrupted by one of the openings 42 necessary for unmolding the plastic ring 28. Extending through this opening 42 is a projection 53 of the upper mold part 52 of the injection mold, its end surface providing a mold surface 58 for shaping an outer surface 60 of the outer detent means 38.

Following injection molding of the plastic ring 28, the upper mold part 52 of the injection mold is removable from the lower mold part 54 in upward direction, whereby the projections 53 of the upper mold part 52 are withdrawn through the openings 42 in the yoke wall 34 of the plastic ring 28.

Figure 4:
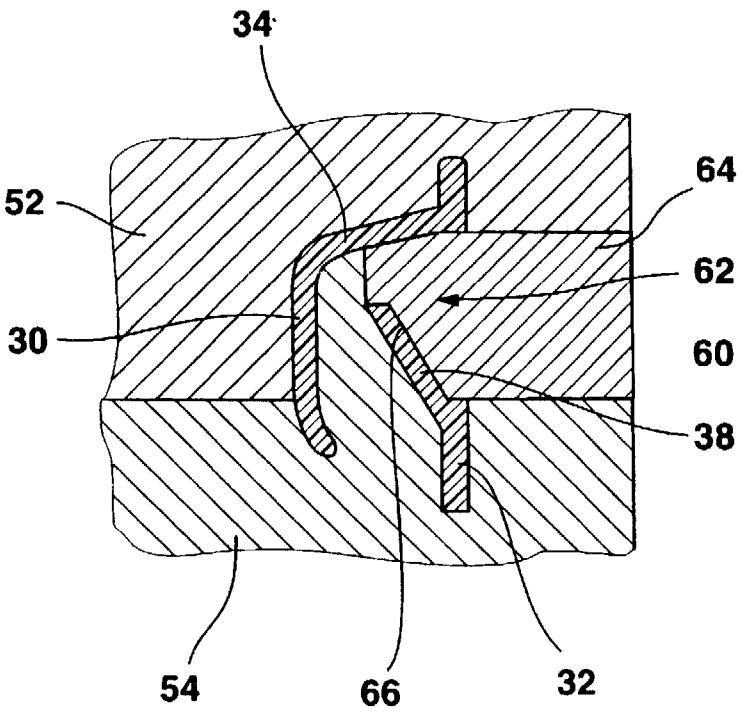
FIG. 4 is a view of another embodiment of an injection mold similar to the injection mold of FIG. 3.

FIG. 4 is a sectional view corresponding to that of FIG. 3 but illustrating another embodiment of an injection mold (like parts having been assigned like reference numerals). The injection mold is equally comprised of an upper mold part 52 and a lower mold part 54. An opening 62 for unmolding the plastic ring 28, in lieu of being provided in the yoke wall 34 of the plastic ring 28, is provided radially outside the outer detent means 38 in the outer leg wall 32. Extending through this opening 62 between the upper mold part 52 and the lower mold part 54 is a third part 64 of the injection mold. An end surface of this third part 64 provides a mold surface 66 for shaping the outer surface 60 of the outer detent means 38.

For unmolding the injection-molded plastic ring 28, first the third parts are radially outwardly withdrawn from the openings 62 of the plastic ring 28 and from the injection mold 52, 54, enabling the mold to be subsequently opened for removal of the plastic ring 28.

We claim:

1. A carafe for carrying a beverage, comprising:

a vessel structure having an opening bounded by an upper rim, said upper rim including an inner surface and an outer surface, said inner surface having an inner undercut which in a downward direction from said opening extends away from a centerline of said opening and said outer surface having an outer undercut which in the downward direction extends toward said centerline of said opening, and a ring structure which can be seated on said upper rim, said ring structure having elastic inner detent structure rearwardly engaging said inner undercut provided on the upper rim of the vessel and elastic outer detent structure rearwardly engaging said outer undercut on said upper rim of said vessel, said elastic outer detent structure configured to elastically deform as said ring structure is seated on said upper rim.

2. The carafe of claim 1 wherein said vessel structure is made of glass.

3. The carafe of claim 2 wherein said ring structure includes a handle for holding the carafe.

4. The carafe of claim 3 wherein said outer undercut extends in a downwardly inclined direction toward said centerline of said opening, and said outer detent structure extends in an upwardly inclined direction toward said centerline of said opening, and abuts said outer undercut at approximately right angles.

5. The carafe of either claim 2 wherein said outer undercut extends in a downwardly inclined direction toward said centerline of said opening, and said outer detent structure extends in an upwardly inclined direction toward said centerline of said opening, and abuts said outer undercut at approximately right angles.

6. The carafe of claim 5 wherein said outer detent structure includes a plurality of outer detent portions which are circumferentially spaced on said ring structure.

7. The carafe of claim 6 wherein said ring structure has a section that embraces said upper ring of said vessel, said section having openings above said outer detent structure, each said opening being at least as large as the contour of a respective said outer detent portion, as seen looking from above.

8. The carafe of claim 6 wherein said ring structure includes a section that encloses said upper rim of the vessel on the outside, said section being provided with openings radially outside said outer detent structure, each said opening being at least as large as the contour of a respective said outer detent portion, as seen looking from outside.

9. The carafe of claim 2 wherein said inner detent structure is of hollow ring configuration and includes an enlargement that rearwardly engages said inner undercut of said vessel.

10. The carafe of claim 9 wherein said enlargement rests against said vessel in sealing engagement therewith.

11. The carafe of claim 2 wherein said ring structure includes spacing structure that engages said upper rim of said vessel.

12. The carafe of claim 2 wherein said ring structure includes a pouring spout.

13. The carafe of claim 12 wherein said ring structure includes handle structure and a heat-insulating hand guard that covers said vessel on the outside in the area of said handle structure.

14. The carafe of claim 2 wherein said ring structure includes structure for releasable attachment of a lid to said carafe.

15. The carafe of claim 2 wherein said ring structure is fabricated from plastics.

* * * * *